US012728499B2

(12) United States Patent
Slutz

(10) Patent No.: US 12,728,499 B2
(45) Date of Patent: Sep. 8, 2026

(54) HYBRID CMP CONDITIONING HEAD

(71) Applicant: Best Engineered Surface Technologies, LLC, Dallas, TX (US)

(72) Inventor: David Earl Slutz, Bethlehem, PA (US)

( * ) Notice: Subject to any disclaimer, the term of this patent is extended or adjusted under 35 U.S.C. 154(b) by 0 days.

(21) Appl. No.: 17/187,858

(22) Filed: Feb. 28, 2021

(65) Prior Publication Data

US 2021/0187696 A1 Jun. 24, 2021

Related U.S. Application Data

(63) Continuation-in-part of application No. PCT/GB2019/052175, filed on Aug. 2, 2019.

(60) Provisional application No. 62/725,578, filed on Aug. 31, 2018.

(30) Foreign Application Priority Data

Oct. 2, 2018 (GB) ..... 1816102

(51) Int. Cl.
*B24B 53/017* (2012.01)

(52) U.S. Cl.
CPC ..... *B24B 53/017* (2013.01)

(58) Field of Classification Search
None
See application file for complete search history.

(56) References Cited

U.S. PATENT DOCUMENTS

2005/0025973 A1* 2/2005 Slutz ..... B24B 53/12 428/408
2005/0085169 A1* 4/2005 Cooper ..... B24D 3/32 451/41
2008/0014845 A1* 1/2008 Yilmaz ..... B24B 53/017 451/443
2008/0153398 A1* 6/2008 Sung ..... B24B 53/017 451/443
2009/0093195 A1* 4/2009 Sung ..... B24D 3/007 51/300
2009/0224370 A1* 9/2009 Slutz ..... B24B 53/12 438/692
2010/0203811 A1* 8/2010 Philipossian ..... B24B 53/017 451/72
2012/0220205 A1* 8/2012 Wu ..... B24D 3/14 51/307
2014/0113532 A1* 4/2014 Smith ..... B24B 53/017 451/443
2015/0044950 A1* 2/2015 Shen ..... B24B 53/017 451/443
2015/0072595 A1* 3/2015 Sung ..... B24D 3/28 51/297

* cited by examiner

*Primary Examiner* — David S Posigian
*Assistant Examiner* — Dana Lee Poon
(74) *Attorney, Agent, or Firm* — Ferguson Braswell Fraser Kubasta PC

(57) ABSTRACT

In various implementations, a conditioning head includes a substrate comprising a substrate surface; and at least one raised non-planar abrasive region relative to the substrate surface. The non-planar abrasive region comprises an edge shaving region and a point cutting region, the ratio of the surface area of the edge shaving region to the point cutting region is at least 2:1; and wherein the cutting point region comprises one or more protrusions extending no more than 250 microns from the mean height of the edge shaving region.

19 Claims, 8 Drawing Sheets

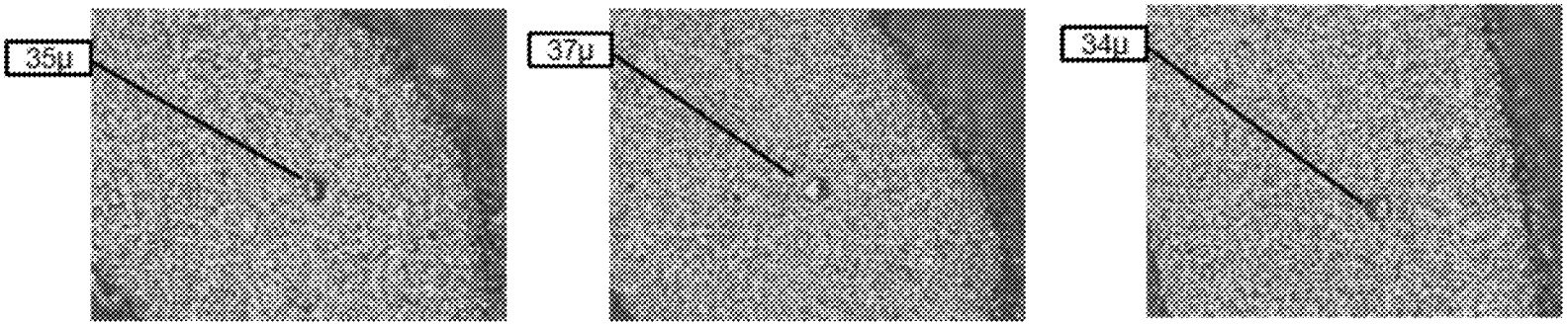
Figure 2a
Figure 2b
Figure 2c
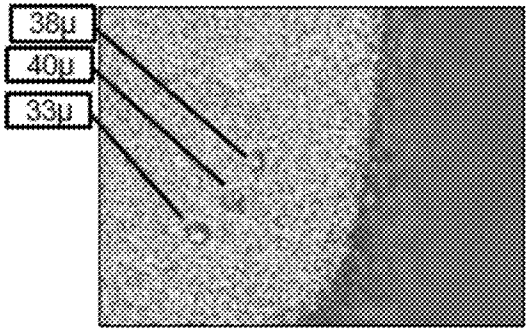
Figure 2d
Figure 2e
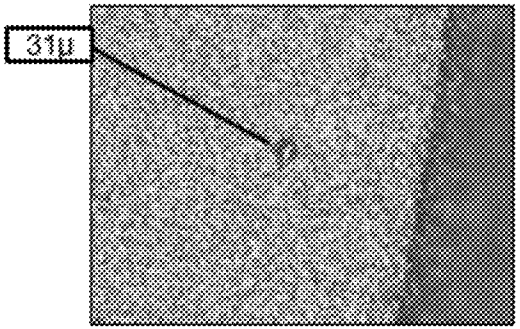
Figure 2f 54 Figure 3a

HYBRID CMP CONDITIONING HEAD

CROSS-REFERENCE TO RELATED APPLICATIONS

This application is a continuation of International Application No. PCT/GB2019/052175 entitled "Hybrid CMP Conditioning Head" and filed on Aug. 2, 2019, which claims the benefit of priority to U.S. Provisional Patent Application 62/725,578 entitled "Hybrid CMP Conditioning Head" and filed on Aug. 31, 2018 and Great Britain Patent Application 1816102.6 entitled "Hybrid CMP Conditioning Head" and filed on Oct. 2, 2018, all of which are incorporated by reference herein for all purposes.

FIELD OF THE INVENTION

The present invention relates generally to a conditioning head comprising a shaving edge. More specifically, the present invention relates to conditioning heads comprising a substrate of various non-planar configurations and methods for manufacturing thereof.

BACKGROUND TO THE INVENTION

The products of the present invention have utility in a wide variety of applications, including heads or disks for the conditioning of polishing pads, including pads used in Chemical-Mechanical-Planarization (CMP). CMP is an important process in the fabrication of integrated circuits, disk drive heads, nano-fabricated components, and the like. For example, in patterning semiconductor wafers, advanced small dimension patterning techniques require an absolutely flat surface. After the wafer has been sawed from a crystal ingot, and irregularities and saw damage have been removed by rough polishing, CMP is used as a final polishing step to remove high points on the wafer surface and provide an absolutely flat surface. During the CMP process, the wafer will be mounted in a rotating holder or chuck and lowered onto a pad surface rotating in the same direction. When a slurry abrasive process is used, the pad is generally a cast and sliced polyurethane material or a urethane-coated felt. A slurry of abrasive particles suspended in a mild etchant is placed on the polishing pad. The process removes material from high points, both by mechanical abrasion and by chemical conversion of material to, e.g., an oxide, which is then removed by mechanical abrasion. The result is an extremely flat surface.

In addition, CMP can be used later in the processing of semiconductor wafers when deposition of additional layers has resulted in an uneven surface. CMP is desirable in that it provides global planarization across the entire wafer, is applicable to all materials on the wafer surface, can be used with multi-material surfaces, and avoids use of hazardous gases. As an example, CMP can be used to remove metal overfill in damascene inlay processes.

CMP represents a major portion of the production cost for semiconductor wafers. These CMP costs include those associated with polishing pads, polishing slurries, pad conditioning disks and a variety of CMP parts that become worn during the planarizing and polishing operations. The total cost for the polishing pad, the downtime to replace the pad and the cost of the test wafers to recalibrate the pad for a single wafer polishing run can be quite high. In many complex integrated circuit devices, up to thirty or more CMP runs may be utilized for each finished wafer, which further increases the total manufacturing costs for such wafers.

With polishing pads designed for use with abrasive slurries, the greatest amount of wear on the polishing pads is the result of polishing pad conditioning necessary to place the pad into a suitable condition for wafer planarization and polishing operations. A typical polishing pad comprises closed-cell polyurethane foam approximately 1/16 inch thick.

Pad conditioning determines the asperity structure (peaks and valleys) of the pad and acts to maintain the surface stability. During pad conditioning, the pads are subjected to mechanical abrasion to physically cut through the cellular layers of the surface of the pad. The exposed surface of the pad contains open cells, which trap abrasive slurry consisting of the spent polishing slurry and material removed from the wafer. In each subsequent pad-conditioning step, the ideal conditioning head removes only the outer layer of cells containing the embedded materials without removing any of the layers below the outer layer.

Conditioning also addresses the loss of polish rates caused by glazing of the pad's surface. Glazing is known to be caused by plastic deformation, which flattens the asperity peaks. Conditioning is used to break up the glazed area and restore the asperity structure to the pad.

An ideal conditioning head may:

- achieve a rapid and complete removal of the top-most layer of cells of the polishing pad with the least possible removal of underlying cell layers of the polishing pad that do not contain embedded materials to maximize the useful life of the pad;
- rejuvenate the asperity structure of the pad to maintain the polishing rate and performance of the pad; and
- remove the spent slurry and debris from the conditioning pad's pores without cutting out the pores, resulting in less aggressive conditioning and a longer pad life.

Over-texturing of the pad results in a shortening of pad life; under-texturing results in an insufficient material removal rate during the CMP step and a lack of wafer uniformity.

Using the conventional conditioning heads that achieve satisfactory removal rates, numbers of wafer polishing runs as few as 200 to 300 and as many as several thousand (depending on the specific run conditions) can be made before the pad becomes ineffective and must be replaced. Replacement typically occurs after the pad is reduced approximately to half of its original thickness.

As a result, there is a great need for a conditioning head that achieves close to an ideal balance between high wafer removal rates and low pad wear rate, so that the effective life of the polishing pad can be significantly increased without sacrificing the quality of the conditioning.

US20090224370 addresses this need by providing a conditioning head which utilises a non-planar edge shaving region. The use of a non-planar edge shaving region was born from the discovery that damage to fixed abrasive pads (and other sensitive CMP pads) resulting from contact with conditioning heads can be considerably reduced by avoiding the presence of large diamond crystals in the conditioning head surface due to the "point cutting" aspect of the larger individual diamond crystals ordinarily grown. Whilst this conditioning head reduces pad wear rates, there are still opportunities to improve the rate at which debris shaved from the wafer is removed, as well as increasing slurry retention on the pad during the CMP process.

SUMMARY OF THE INVENTION

In various implementations, a conditioning head may include a substrate comprising a substrate surface; and at least one raised non-planar abrasive region relative to the substrate surface. The non-planar abrasive region may include an edge shaving region ($R_{es}$), which includes a surface roughness $R_{p1}$, and a point cutting region ($R_{cp}$), which includes one or more protrusions resulting in a surface roughness $R_{p2}$. The ratio of the surface area of the edge shaving region to the point cutting region may be at least approximately 2: approximately 1 and the ratio of $R_{p2}$ to $R_{p1}$ may be at least approximately 2: approximately 1.

In some implementations, a conditioning head may include: a substrate comprising a substrate surface; and at least one raised non-planar abrasive region relative to the substrate surface. The non-planar abrasive region may include an edge shaving region and a point cutting region. The ratio of the surface area of the edge shaving region to the point cutting region may be at least approximately 2: approximately 1. The point cutting region may include one or more protrusions extending no more approximately 1 mm, no more than approximately 500 μm, and/or no more than approximately 250 μm from mean height of the edge shaving region.

In some implementations, a conditioning head may include a substrate comprising a substrate surface; and at least one raised non-planar abrasive region relative to the substrate surface. The raised abrasive region(s) may include a shaving edge and cutting point(s) to form an abrasive cutting/shaving front. Cutting point(s) may include at least one protrusion extending no more than 1 mm or no more than approximately 500 μm and/or no more approximately 250 μm from a shaving edge plane. At least one protrusion may comprise no more than approximately 10% of the abrasive cutting/shaving front, in some implementations.

As a non-limiting example, two protrusions having a base dimension of 100 μm position along the leading edge of each spiral with a length of 100 mm (100,000 μm) would make up 0.1% of the cutting/shaving front.

In some implementations, the one or more protrusions make up no more than 5% or 1% or 0.5% or 0.3% or 0.2% or 0.1% of the cutting/shaving front. (i.e. if vane has a leading edge (i.e. in the direction of rotation) length of 50,000 μm and the protrusion has a leading edge of 50 μm (e.g. circular protrusion of 50 μm diameter), then the protrusion would make up 0.1% of the cutting/shaving front).

The non-planar edge shaving region, in some implementations, may include more than 2 or 4 or 6 or 8 or 10 or 12 linear or spiral vanes radiating from a central axis region of the conditioning head.

The surface of the conditioning head is, in some implementations, coated with CVD diamond. The CVD diamond coating provides a highly abrasive and durable surface, which also seals the conditioning head to prevent the transfer of contaminating material from the substrate layer on to the polishing pad and slurry. However, it would be appreciated that use of a CVD diamond layer is not essential in many embodiments for the working of the present invention. For example, the cutting point region may comprise diamond grit or diamond grit composite protrusions adhered to the substrate, with no CVD coating layer. It will be understood that diamond grit may be substitutable for other abrasive particles such as carbides and nitrides.

In some implementations, a conditioning head may include a substrate comprising a substrate surface, at least one non-planar raised edge shaving region ($R_{es}$) relative to the substrate surface, and at least one non-planar raised cutting point region ($R_{cp}$) relative to the substrate surface. At least one non-planar raised edge shaving region comprises a roughness $R_a$ of less than 10 μm and at least one non-planar raised cutting point region comprises a roughness $R_p$ in the range of 5 μm and 250 μm relative to the mean height of at least one non-planar raised edge shaving region; and wherein the ratio of the surface area of $R_{es}$ to the surface area to $R_{cp}$ is greater than 2:1.

The at least one raised edge shaving region is, in some implementations, coated with a CVD diamond layer.

In some implementations, a conditioning head may include a substrate comprising a substrate surface, and at least one raised abrasive region relative to the substrate surface. The non-planar abrasive region may include an edge shaving region, which includes a mean CVD diamond coating thickness $S_a$, and a cutting point region, which includes one or more protrusions, and having a mean CVD diamond coating thickness $S_b$, the ratio of said surface area of the edge shaving region to the surface area of the cutting point region is at least approximately 2: approximately 1.

In some implementations, the ratio of $S_b$ to $S_a$ is at least 2:1.5. The ratio of $S_b$ to $S_a$ may be at least or at least 1½:1. In some implementations, the ratio of $S_b$ to $S_a$ may be at least 2:1 or 3:1.

The surface roughness resulting from growing CVD diamond on a substrate typically ranges from about 2 to 5 microns from peak-to-valley on a substrate having a thickness of about 10 microns of CVD diamond. In general, the peak-to-valley surface roughness for a typical CVD diamond layer ranges from about ¼ to about ½ the thickness of the CVD diamond that is grown on the substrate. The thickness of the diamond film layer may be about 1 to about 50 microns. In some implementations, thickness of the diamond film layer may be about 5 to about 30 microns. The thickness of the diamond film layer may be about 10 to about 18 or 20 microns.

Correspondingly for CVD diamond coating embodiments, $R_{p1}$ may be approximately 0.25 μm to approximately 25 μm. $S_a$ may be approximately 1 to approximately 50 μm.

The described conditioning head may provide a combination of edge shaving and point cutting to provide a desirable combination of low pad wear rate, excellent wafer material removal rates and slurry retention to provide a long pad life and/or a low rate of wafer imperfections. In contrast to conventional conditioner heads, the portion of the conditioner head of the present invention having a point cutting function is very low on an absolute level. As a result, the conditioned polishing pads have fewer and/or shallower asperities.

Edge Shaving Region

The edge shaving region is substantially parallel with the conditioning head plane. The edge shaving region may be raised approximately between 0.1 mm to 5 mm or approximately between 0.5 mm to 2 mm from the substrate surface of the conditioning head.

The edge shaving region ($R_{es}$) may have a surface roughness $R_a$ of less than 10 μm. In some implementations, the edge shaving region ($R_{es}$) may have a surface roughness $R_a$ of less than 6 μm. The edge shaving region ($R_{es}$) may have a surface roughness $R_a$ of less than 3 μm. In some implementations, the edge shaving region ($R_{es}$) may have a surface roughness $R_a$ of less than 1 μm. A low surface roughness results in shallow asperities in the polishing pad and low pad wear rates. A shaving edge surface may have a roughness $R_a$ of at least 0.1 μm. A shaving edge surface may have a roughness $R_a$ of at least 0.2 μm, in some implementations.

The shaving edge is the leading edge of the raised, non-planar, edge shaving region, which comes into first contact with the polishing pad during conditioning. This can result in the edge shaving region "shaving" the surface of the pad rather than "scratching" and cutting the pad.

The area of the edge shaving region may be less than 80%, less than 50%, less than 25%, less than 10%, less than 5%, or less than 2% of the area of the area of the substrate surface of the conditioning head. Additionally or alternatively, the area of edge shaving region may be more than 0.5%, more than 1%, more than 2%, more than 5%, or more than 10% of the area of the substrate surface of the conditioning head.

Cutting Point Region

The cutting point region (or $R_{cp}$) provides a source of cutting points that rejuvenate the polishing pad's surface by forming asperities, thereby eliminating glazed areas on the pad. The quantity and height of the protrusions forming the cutting points dictate the asperity structure provided to the polishing pad. In applications in which a low pad wear rate is required, lower and fewer protrusions may be utilized.

It has been found that the combination of a shaving edge combined with a small amount of cutting points enables the conditioner to most effectively perform its function. It is considered that the use of a shaving edge alone is unable to effectively break up glazed areas of the polishing pad and remove embedded contaminants; the use of cutting points alone is unable to effectively break up glazed areas and remove contaminants without high pad wear rates. The present invention has been able to combine the benefits of both conditioning techniques.

In some implementations, there may be no more than 50 protrusions, no more than 30 protrusions, and/or no more than 20 protrusions. There may be no more than 10 protrusions. There may be at least one protrusion. In some implementations, there may be at least two protrusions, at least 4 protrusions, and/or at least 8 protrusions.

Each protrusion has a height above the mean height of the edge shaving region—for example, approximately 5 μm to approximately 250 μm, approximately 10 μm to approximately 150 μm, approximately 15 μm to approximately 100 μm, approximately 20 μm to 60 μm and/or approximately 20 to approximately 70 μm. In embodiments with low polishing pad wear rates, each protrusion may have a height above the mean height of the edge shaving region—for example, less than approximately 55 μm, less than approximately 50 μm, less than approximately 45 μm, and/or or less than approximately 40 μm.

Each protrusion has a cross-sectional length parallel to the shaving edge—for example approximately 10 μm to approximately 250 μm, approximately 10 μm to approximately 150 μm, and/or approximately 15 μm to approximately 100 μm. In some implementations, the cross-sectional length may be approximately 20 μm to approximately 60 μm and/or approximately 20 to approximately 70 μm.

One or more of the protrusions may be rounded, convex, and/or have a flat top surface. In some implementations, all of the protrusions may be similar. In some embodiments, the protrusions are geometric in shape and configuration with other protrusions. In other embodiments, the protrusions are non-geometric in shape and configuration with other protrusions. Due to the relatively small number of protrusions compared to conventional conditioning heads, consistent conditioner head performance may be achieved by obtaining protrusions within specified dimensional ranges rather than exact geometric shapes. In particular, conditioner heads are monitored to screen out over-sized protrusions that may detrimentally impact upon the balance between pad wear rate, wafer material removal from the polishing pad, rejuvenation of asperity structure of the polishing pad, and slurry retention of the polishing pad. The conditioning heads of the present invention are able to provide conditioned polishing pads with an asperity structure which results in a higher density of smaller contact interfaces with the wafer. These smaller contact interfaces enables improved wafer material removal and lower defects, as the smaller contact interfaces can more readily maintain a lubricated state.

The cutting point region may comprise or consist of one or more protrusions. In embodiments, in which the cutting point regions consist of one or more protrusions, the one or more protrusions may protrude from the edge shaving region. In embodiments in which the point cutting region comprises one or more protrusions, the one or more protrusions may protrude from a mean height which is above the mean height of the edge shaving region. For example, the point cutting region may comprise a raised plateau with protrusions thereon.

The protrusions of the point cutting region may be less than approximately 10%, less than approximately 5%, and/or less than approximately 1%. The protrusions of the point cutting region may be less than approximately 0.5%, less than approximately 0.4%, less than approximately 0.3%. less than approximately 0.2%, and/or less than approximately 0.1% of the area of the shaving edge(s) of the conditioner head. If the point cutting region is too large or contains protrusions that are too high or acute, the hybrid nature of the conditioning head may be lost, with the cutting points more aggressively removing pad material, such that the low material removal rates achieved by the shaving edge region are nullified. As a result, the conditioning head functions as a cutting point conditioning head.

$R_{cp}$ and $R_{es}$ may be contiguous with protrusions of the $R_{cp}$ rising from the $R_{es}$. However, it will be understood that the point cutting region may be non-contiguous to the edge shaving region.

The ratio of the surface area of said edge shaving region to said point cutting region may be at least approximately 5: approximately 1, at least approximately 10: approximately 1, at least approximately 50: approximately 1, at least approximately 100: approximately 1, and/or at least approximately 200: approximately 1. The described conditioning head may be still based upon a shaving edge to remove the majority of pad material, whilst the cutting point portion of the conditioning head may be focused upon conditioning the pad's surface (i.e. providing the asperity structure), rather than on material removal. As such, the portion of the conditioning head which functions as a cutting points may be relatively small compared to the portion that functions as a shaving edge.

The point cutting region may be positioned greater than approximately 50%, greater than approximately 60%, greater than approximately 80%, and/or greater than approximately 90% along a straight radial line between a central axis and a peripheral edge of the conditioning head. The outermost protrusion may be positioned within approximately 5 mm, within approximately 3 mm, and/or within approximately 2 mm of the peripheral edge of the conditioning head. By positioning the protrusions in close proximity to the peripheral edge of the conditioning edge, the point cutting protrusions of the conditioning head will more readily cover the entire polishing pad surface during the conditioning process. This enables a smaller proportion of cutting points to be used, thereby reducing pad wear rates.

In embodiments where more than one protrusion is clustered together, the protrusions may be aligned along the cutting edge.

In some implementations, the ratio of the surface area of the base of the protrusion to the surface area of the top of the protrusion is less than approximately 5: approximately 1 and/or less than approximately 2: approximately 1. This combination of features results in relatively shallow asperities in the polishing pad. These shallow asperities are thought to be conducive to wafer material removal from the pad and slurry retention thereon, whilst minimising increases in the pad wear rate. It will be appreciated that the characteristics of the protrusions may vary depending upon the nature of the polishing pad, slurry and wafer.

It will be also appreciated that the protrusion(s) may be formed via a number of methods. In one embodiment, the protrusion comprises CVD diamond coated diamond grit. In another embodiment, the protrusion comprises a diamond layer of greater thickness on a substantially flat substrate. In a further embodiment, the protrusion comprises a CVD diamond coating on a protrusion in the adjacent substrate.

In one embodiment, the cutting point region and the edge shaving region comprise a polycrystalline diamond layer, the average grain size of the polycrystalline diamond on the point cutting region being larger than the average grain size of the polycrystalline diamond on the edge shaving region. The larger grain size may result in the formation of one or more protrusions on the cutting point region.

The raised non-planar abrasive region may include one or more discrete raised non-planar edge shaving segments. The raised non-planar abrasive region may include one or more discrete raised non-planar abrasive segments. The one or more segments may have shape(s) such as concentric circles, broken concentric circles, spirals, broken spiral segments, linear segments, broken linear segments, curved segments, broken curved segments, and/or combinations thereof.

The area of the non-planar abrasive region may be less than approximately 80%, less than approximately 50%, less than approximately 25%, less than approximately 10%, less than approximately 5%, or less than approximately 2% of the area of the area of the substrate surface of the conditioning head. Additionally or alternatively, the area of the non-planar abrasive region may be more than approximately 0.5%, more than approximately 1%, more than approximately 2%, more than approximately 5%, or more than approximately 10% of the area of the area of the substrate surface of the conditioning head. The non-planar abrasive region may be raised approximately 0.1 mm to approximately 5 mm and/or approximately 0.5 mm to approximately 2 mm from the substrate surface of the conditioning head.

In embodiments where the raised segment comprises concentric circles, the outermost concentric ring comprises the cutting point region.

The cross section of the raised non-planar cutting edge region may have a shape of a truncated triangle, with two inclining sides framed by a substantially level top surface. The width of the top surface is may be approximately 0.5 mm to approximately 10 mm wide and/or approximately 1.0 mm to approximately 6 mm wide.

In one embodiment, the point cutting region is distributed across one or more of the segments. For example, the point cutting region may be distributed across less than approximately 60% of the segments.

In some embodiments, the point cutting region comprises one or more isolated or clusters of protrusions.

In one embodiment, the conditioning head as previously described in the first to fifth aspects of the present invention wherein the raised non-planar abrasive region or $R_{es}$ comprises at least four radially extending vanes and between one and fifty protrusions, wherein each vane comprises between zero and five protrusions and said protrusion(s) are positioned greater than 70% along a radial line starting from the central axis and ending at the peripheral edge of the conditioning head.

In some implementations, at least approximately 50% of the vanes include at least one protrusion. At least approximately 75% of the vanes may include at least one protrusion. Every vane may include at least one protrusion, in some implementations.

In one embodiment, the number of protrusions per vane may be approximately one to approximately three. In another non-limiting embodiment, alternative vanes may include approximately one to approximately three protrusions.

Average roughness ($R_a$) is a measure of the relative degree of coarse, ragged, pointed or bristle-like projections on a surface, and is defined as the average of the absolute values of the differences between the peaks and their mean line.

$R_p$ is the height of the highest peak above the mean line in the sample length.

The point cutting region is defined as a surface area comprising or consisting of one or more protrusions. The point cutting region has a surface area defined as the surface area of the base of the protrusion for isolated protrusions. For clusters of protrusions, the surface area of the protrusions is deemed to be the area encompassing the protrusions, which are spaced not more than approximately 100 μm apart and/or no more than approximately 50 μm apart.

As used herein, the term "ceramic" is to be interpreted in its widest sense as including not only oxides but also non-oxide materials, for example silicon carbide or silicon nitride.

As used herein, the meaning of the term "conditioning" encompasses the removal of the outer layers of the polishing pad and the embedded wafer material embedded therein and/or the rejuvenation of the polishing pad's asperity structure. As used herein, the term "conditioning head" and the term "conditioner head" are terms which may be used interchangeably.

As used herein, the term "wear rate" (unless context dictates otherwise) means the rate of removal of the outer layers of the polishing pad, which is a measure of the durability of the polishing pad.

As used herein, the term "cutting point region" refers to an area of the conditioning head that conditions the polishing pad through the action of protrusions, which form a cutting point.

As used herein, the terms "shaving edge region" and "edge shaving region" refer to an area of the conditioning head that conditions the polishing pad through the action of a non-planar edge based feature(s). The shaving edge may include an elongated edge of a constant height, in some implementations.

As used herein, the term "carbide-forming material" means a material that is capable, under appropriate conditions, of formation of a covalently bonded compound with carbon in a carbide. It is believed that regions of the carbide-forming material react with the depositing CVD diamond material to form regions of bonded carbide structures at the interface between the substrate and the CVD diamond layer, resulting in strong adhesion of the diamond layer to the substrate.

The term "non-planar" refers to the existence of edge-based shaving or cutting point features raised out of the natural plane of the otherwise substantially level conditioning head. In this way, the raised features are said to be out of plane, or non-planar, relative to the conditioning head plane.

Surface area measurements referred herein relate to the planar surface area (i.e. measurement of the plane rather than the surface topology).

"Cutting point" and "point cutting" are terms which may be used interchangeably.

BRIEF DESCRIPTION OF THE FIGURES

FIGS. 2*a* to 2*f* are magnified optical images of a spiral vane surface on the conditioner head represented in FIGS. 1*a* and 1*b*.

FIG. 3*a* is an image of a diamond particle adhered to the substrate prior to diamond CVD.

DETAILED DESCRIPTION OF AN EMBODIMENT OF THE PRESENT INVENTION

Figure 1A:
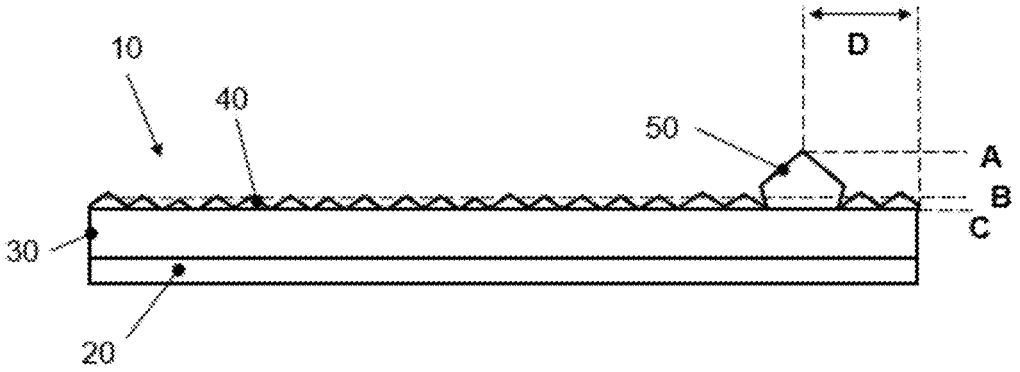
FIGS. 1*a* and 1*b* are schematic diagrams of a cross section of a portion of the conditioner head, in accordance with one embodiment of the present invention.

FIG. 1*a* illustrates a cross-sectional portion of a conditioning head 10 though a longitudinal portion of a spiral vane, with the left side positioned proximal to the central axis of the conditioning head and the right side forming the peripheral edge. The conditioning head comprises a backing plate 20, such as a stainless steel plate. The substrate 30 may comprise a variety of materials including ceramic material, such as Si and/or $Si_3N_4$, or from at least one ceramic material such as $Al_2O_3$, AlN, $TiO_2$, $ZrO_x$, $SiO_2$, SiC, $SiO_xN_y$, $WN_x$, $Wo_x$, DLC (diamond-like coating), BN and/or $Cr_2O_3$. In some implementations, the substrate is a carbide.

The substrate 30 can be made from a cemented carbide material such as tungsten carbides (WC) such as tungsten carbonite-cobalt (WC—Co), tungsten carbonite-carbon titanium-cobalt (WC—TiC—Co) and/or tungsten carbonite-carbon titanium-carbon tantalium-cobalt (WC—TiC—TaC—Co). The substrate 30 can also be made from other cemented carbide materials such as TiCN, $B_4C$ or $TiB_2$. In some embodiments, the substrate comprises Reaction-Bonded Silicon Carbide (RBSiC) comprising silica carbide and unreacted silica carbide forming material, e.g. Si. Further details on RBSiC are disclosed in U.S. Pat. No. 7,367,875, which is incorporated by reference to the extent it does not conflict with the disclosure herein.

The substrate is usually in the form of a disk ranging in diameter from about two (2) to four (4) inches (about 50 to 100 mm). However, other geometries have been used as the substrate for conditioning heads. The base substrate thickness ranges from about 0.5 mm to about 6.5 mm and/or about 1.0 mm to about 2.0 mm for a silicon substrate. Thicknesses for other substrates may vary from these ranges. For instance, the silicon carbide-silicon composite substrate may have a thickness ranging from about 1.0 mm to about 7.5 mm, although thicknesses outside this range are also feasible. Larger diameter substrates will be correspondingly thicker.

The substrate 30 comprises a raised non-planar abrasive region in the form of a spiral vane. The top of the spiral vane 40 is raised approximately between 0.5 mm to 2 mm from the natural plane of the conditioning head.

Details of the variations in configuration and methods of producing the non-planar abrasive region are further detailed in US20090224370 in the name of the applicant. US20090224370 is incorporated into the current specification to the extent allowable under national law.

The polycrystalline CVD diamond layer 40 typically covers the whole of the conditioning head, although in some embodiments the vanes may be separately attached to a backing plate. The diamond layer 40 forms the edge shaving region, which covers the majority (e.g. >80%) of the top of the spiral vane and/or the vane side. The edge shaving region of the substrate 40 may be first uniformly distributed with about 100 to 5000 grains per $mm^2$ of diamond grit, which may have an average particle diameter of less than 10 μm and/or approximately 0.5 to approximately 2 μm. However, seedless formation of the CVD diamond layer is also possible. The concentration and size of the grain as well as the CVD diamond processing conditions, may be adjusted to achieve the desired surface roughness. Further details of the CVD diamond process are provided in paragraphs 73 to 76 of US20090224370, which is incorporated by reference to the extent that it does not conflict with the disclosures herein. Other seeding methods are disclosed in U.S. Pat. No. 6,054,183, which is incorporated by reference to the extent that it does not conflict with the disclosures herein.

The lateral cross-section view of the vane is the shape of a truncated triangle with the top about 1.1 mm wide. A protrusion 50 (cutting point region) is positioned towards the peripheral edge of the spiral vane at the outer diameter of the conditioning head 10. The protrusion is an enlarged diamond grain adhered to the substrate prior to the CVD diamond layer being applied. The protrusion 50 has a height of 40 μm ($R_{p2}$) above the edge shaving region 40 of AB, corresponding to the difference between the peak height of the protrusion to the peak height of the edge shaving region 40. The mean thickness of the protrusion (relative to the substrate) is about 30 μm. In FIG. 1*a*, the mean CVD diamond layer thickness is about 10 μm for the edge shaving region, with a roughness $R_{p1}$ of about 4 μm.

Figure 1B:
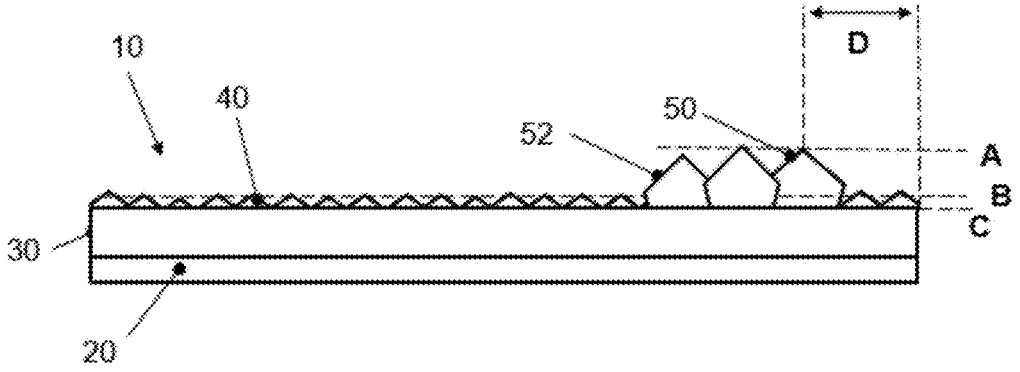

FIG. 1*b* illustrates an embodiment in which the point cutting region is defined between enlarged diamond grains 50 and 52. The diamond height AB is 42 μm ($R_{p2}$), whilst roughness $R_{p1}$ remains at about 4 μm.

Figure 3B:
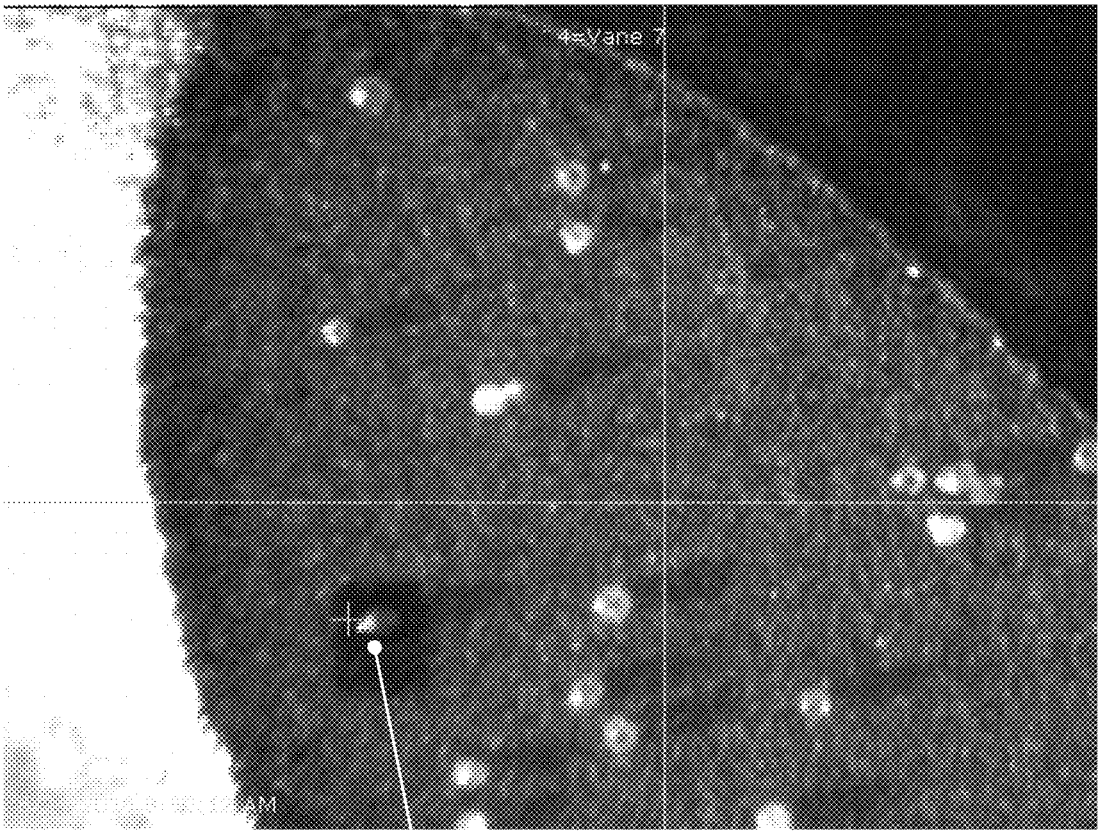
FIG. 3*b* is an image of FIG. 3*a* after diamond CVD.
Figure 3B:
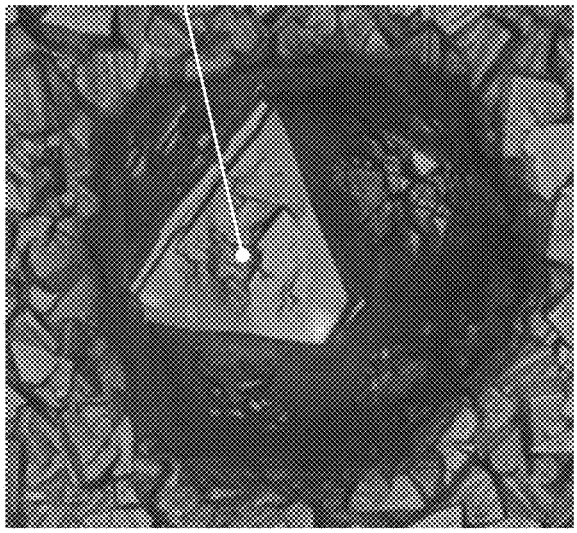
Figure 4:
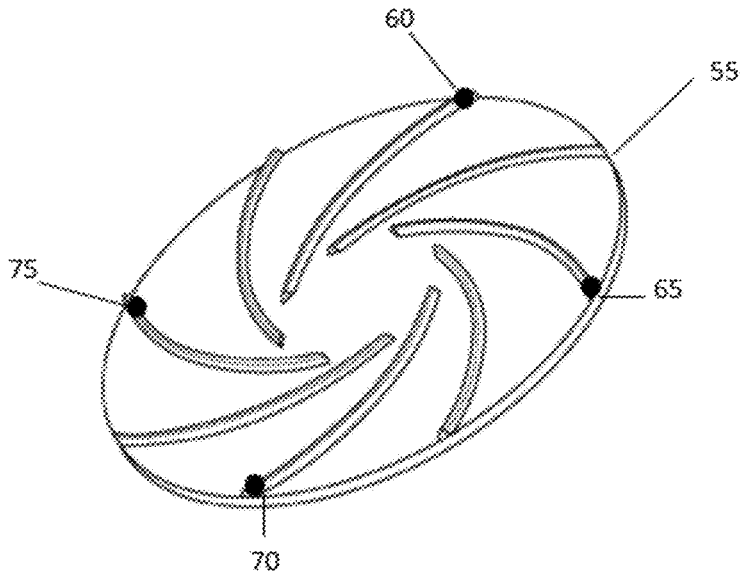
FIG. 4 is a schematic diagram of the conditioner head of FIGS. 1*a* and 1*b*.

FIGS. 2*a* to 2*f* illustrate protrusions 60, 65, 70, 75 positioned towards the peripheral edge of the spiral vanes, such as those illustrated in FIG. 4. The protrusions 60, 65, 70, 75 were formed by adhering single diamond grains (or three diamond grains in FIG. 2*e*) to the predetermined location prior to applying the CVD diamond layer. Through selection of appropriately sized diamond grains, protrusions 60, 65, 70, 75 may be formed within a height tolerance of ±5 μm. In some implementations, protrusion may be formed with a height tolerance of approximately ±3 μm. FIG. 3*a* illustrates a substrate with the diamond grain adhered thereto, whilst FIG. 3*b* illustrates the protrusion formed therefrom after application of the CVD diamond layer. In a variation to the conditioning head of FIG. 4, the spiral vanes 55 form the surface edge shaving region; raised cutting point protrusions 60, 65, 70, 75 may be positioned within approximately 3 mm of the peripheral edge between one or more of the spiral vanes 55 and/or between alternatively spiral vanes 55. The spiral vanes 55 comprise a shaving edge which is able to efficiently remove the top layers of the polishing pad without an excessive pad wear rate. The small portion of raised cutting points is able to rejuvenate the polishing pad surface by breaking up glazed areas and restoring the asperity structure.

When compared to the 3M Trizact B5 pad conditioner, the conditioning head of FIG. 4 created about the same contact area (contact area is the area of the polishing pad that will contact the wafer during CMP under 2 psi load). However, the conditioning head of the present invention had a mean contact density (at 2 psi pressure) of 220 counts/$mm^2$ compared to 129 counts/$mm^2$ when the polishing pad was conditioned with the 3M pad conditioner. These results indicate that the conditioning heads of the present invention are able to produce a polishing pad asperity structure defined by a higher frequency of smaller asperity peaks. This enables improved wafer material removal and lower wafer defects as the contact areas can stay more lubricated. Larger contact areas can become non-lubricated, causing friction and increased defects.

Figure 5:
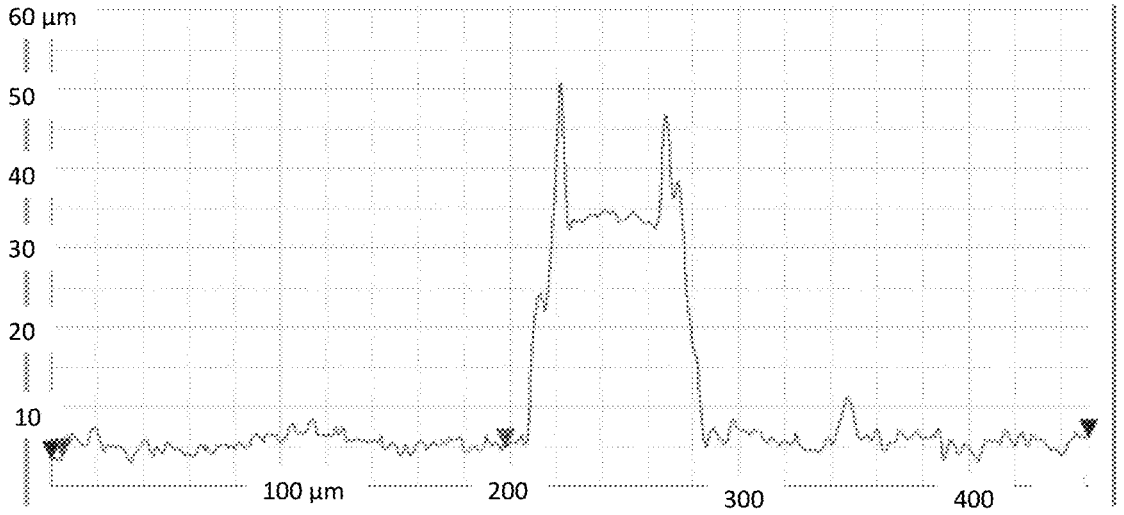
FIG. 5 is a topographic profile of a protrusion (cutting point region) and an adjacent edge shaving region.

FIG. 5 illustrates a portion of a surface profile of a raised spiral vane of FIG. 4. The roughness of the edge shaving region $Rp_1$ is determined by performing a line scan across the full length of the spiral vane (excluding the cutting point region). In FIG. 4, this involved two separate line scans either side of the protrusion. The largest $Rp_1$ between the separate line scans was 8 μm, whilst $Rp_2$ was 41 μm.

Figure 6:
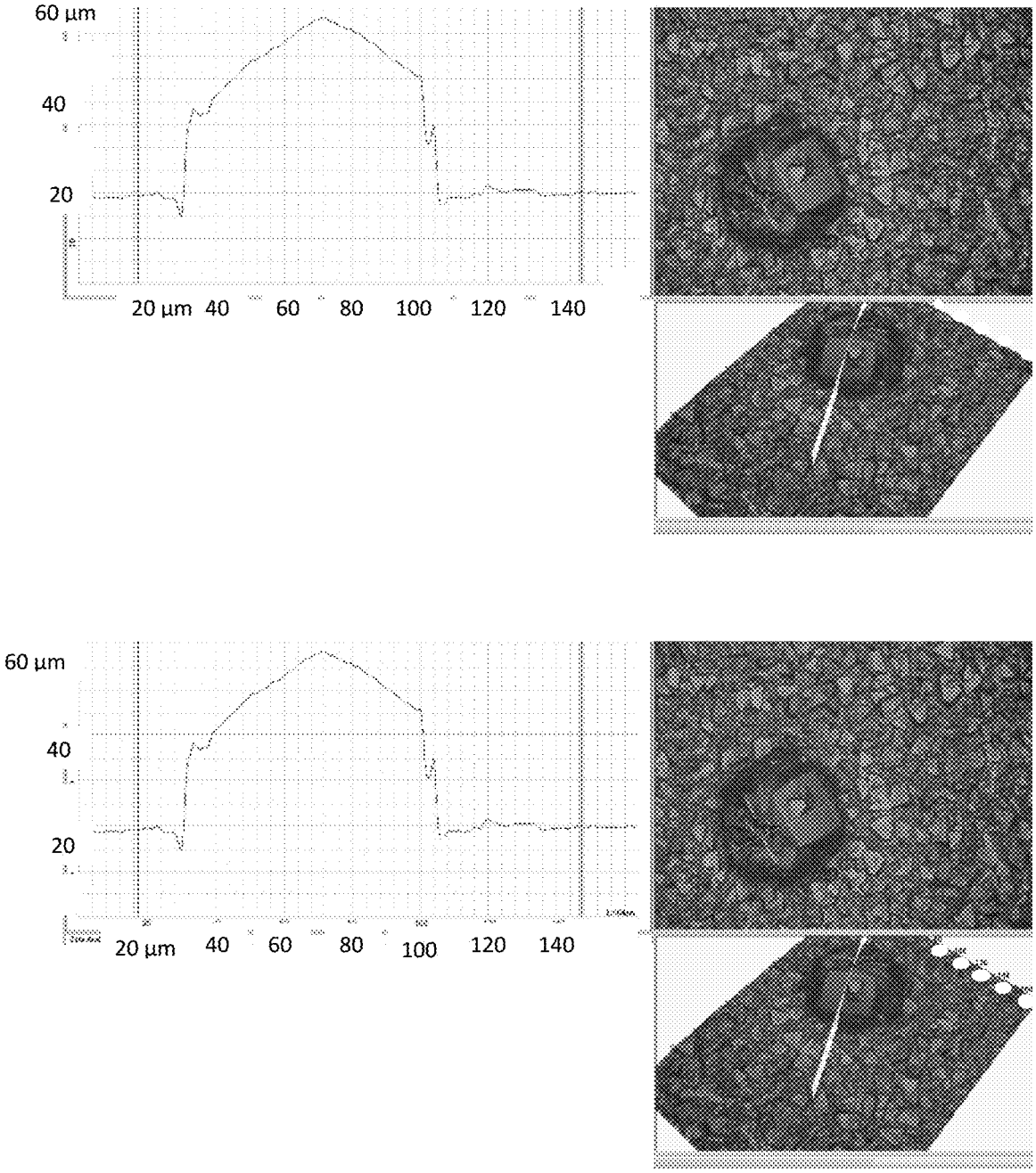
FIGS. 6 to 10 are images and associated topography profiles of the surface of a portion of the conditioner head of FIG. 1*a*.
Figure 7:
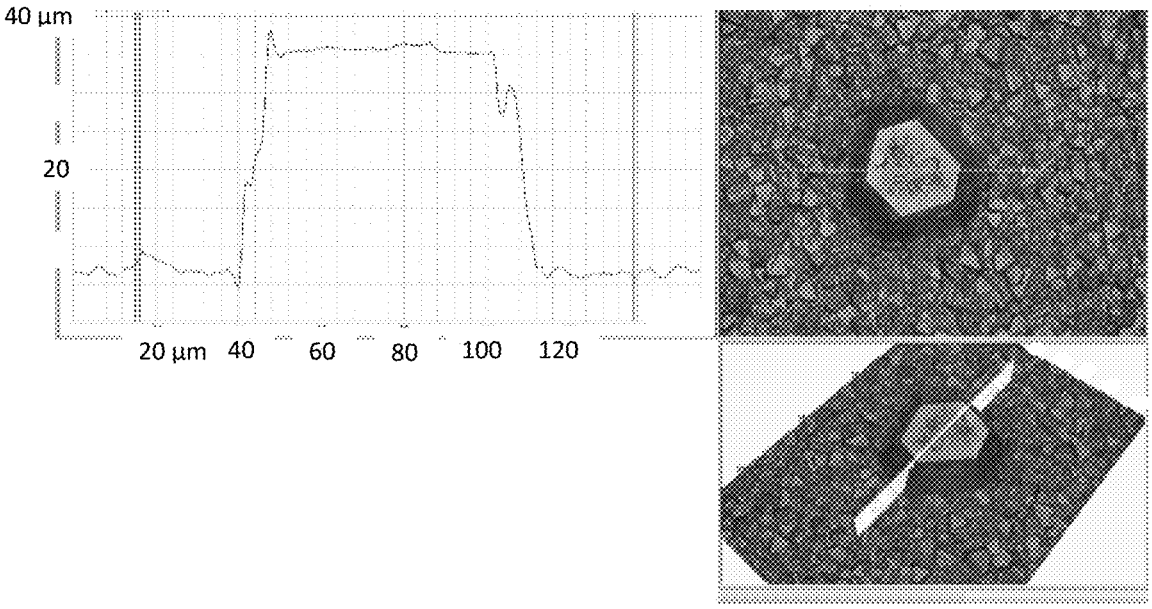
Figure 8:
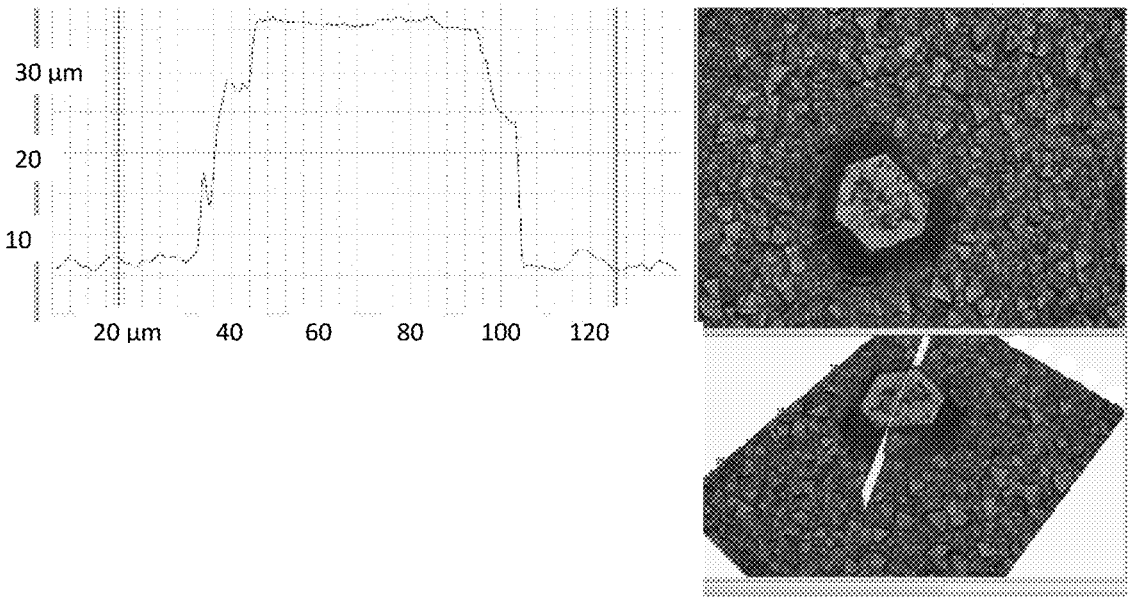
Figure 9:
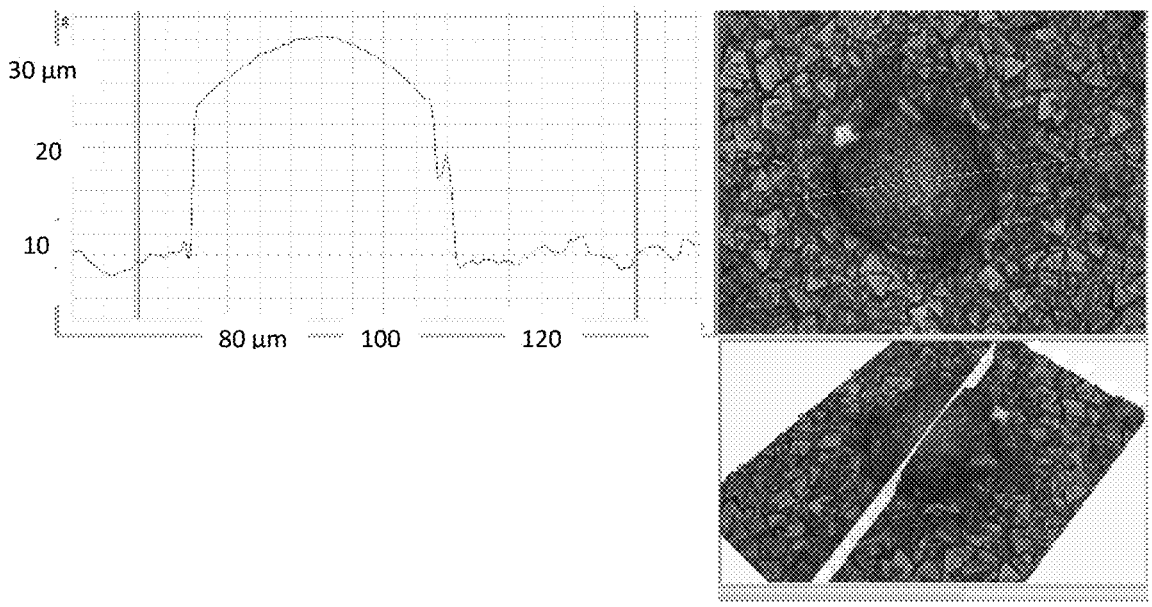
Figure 10:
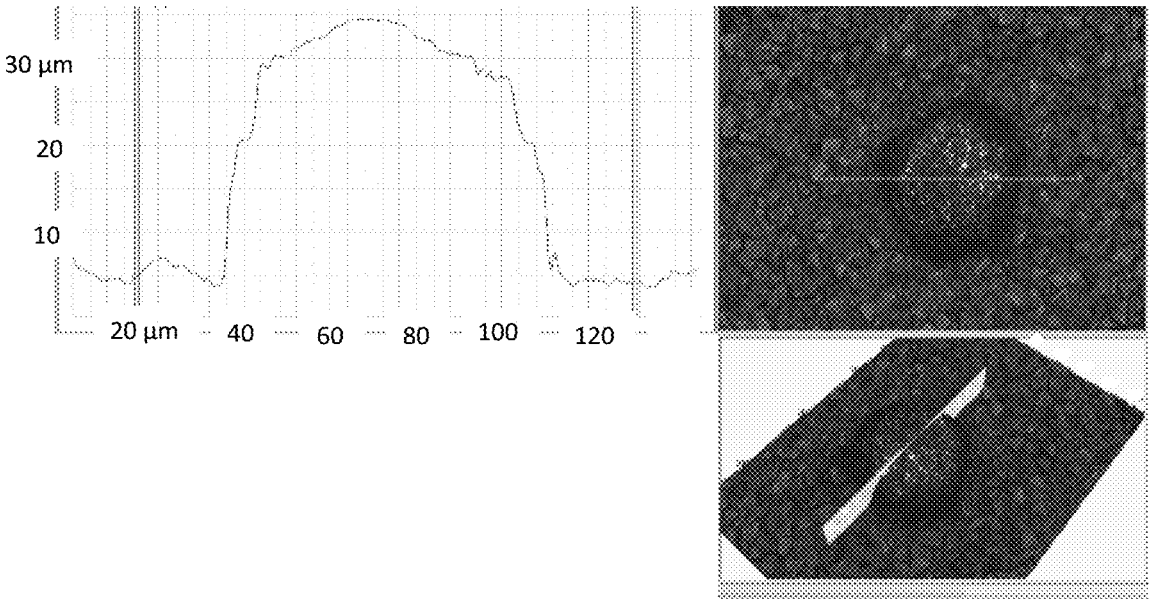
Figure 11A:
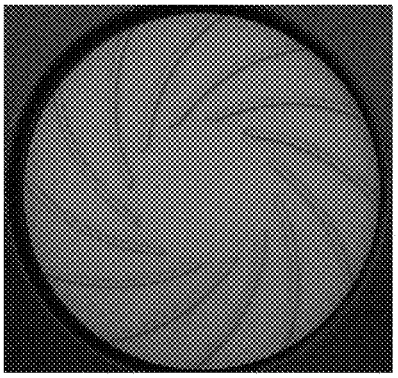
FIG. 11*a* to 11*f* are images of alternative raised non-planar edge shaving regions of conditioner head of the present invention.
Figure 11B:
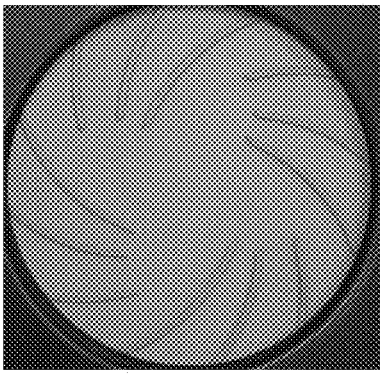
Figure 11C:
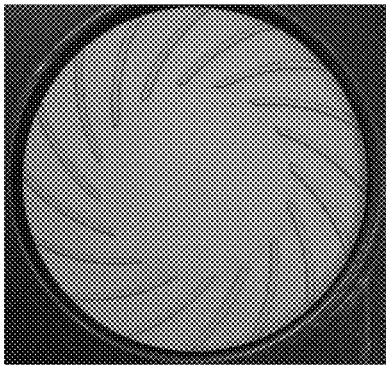
Figure 11D:
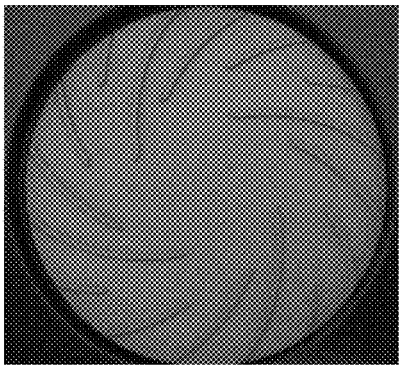
Figure 11E:
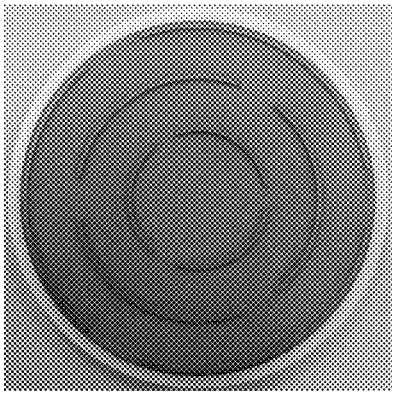
Figure 11F:
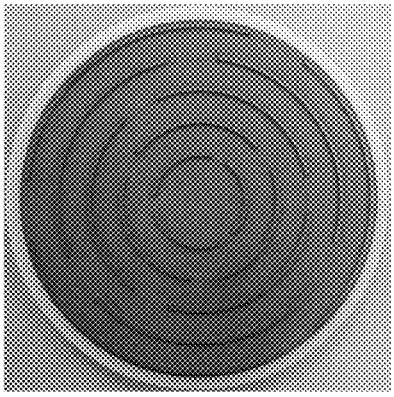

FIGS. 6 to 8 illustrate the shape and dimensions of protrusions formed from the adhering diamond grains to the top surface of the non-planar raised substrate. As illustrated, the protrusions have substantially level top surfaces. FIGS. 9 and 10 illustrate protrusions with rounded tops formed from catalytic seeds, which promoted accelerated diamond growth and resulted in a thicker diamond layer immediately adjacent the catalytic seeds.

The cross-sectional portion of the grains ranged from about 30 μm to 50 μm. The spiral shaving edge vane has a shaving edge length of about 50 mm. Therefore, the portion of the cutting point/shaving edge functioning as cutting points is about 0.06% to 0.10%. For embodiments in which only half of the vanes comprised these protrusions, the portion of the cutting/shaving edge functioning as cutting points would also be halved.

FIGS. 11*a* to 11*f* provide a number of possible configurations of the raised non-planar edge shaving region. The $Rp_1$ in all samples was less than 5 μm, whilst the protrusion heights were all greater than 30 μm and less than 50 μm. In embodiments where the region comprises concentric circular vanes (such as those illustrated in FIGS. 11*e* and 11*f*), the protrusions of the point cutting region may be disposed on the outermost concentric circular vane. The embodiments shown in FIGS. 11*a*, 11*b*, 11*c*, and 11*d* each have a series of spiral raised edge shaving regions.

It will be appreciated that the cutting points may be generated by a variety of means. In one embodiment, the substrate adjacent the cutting point region is distributed with catalytic seeds. Accordingly, the cutting point region may be adjacent catalytic seed(s) disposed upon the substrate. The catalytic seeds may include diamond, silicon, iron, cobalt, nickel and/or alumina. A CVD diamond layer is then deposited, resulting in the cutting point region comprising larger and higher diamond grains relative to the diamond grains forming the edge shaving region.

In another embodiment, the substrate comprises one or more protrusions which form the cutting point region once coated with CVD diamonds.

In yet another embodiment, the cutting point region may be obtained through etching protrusions from a diamond layer, as described in U.S. Pat. No. 8,976,183.

It is to be understood the implementations are not limited to particular systems or processes described which may, of course, vary. It is also to be understood that the terminology used herein is for the purpose of describing particular implementations only, and is not intended to be limiting. As used in this specification, the singular forms "a", "an" and "the" include plural referents unless the content clearly indicates otherwise. Thus, for example, reference to "a shape" includes a combination of two or more shapes and reference to "a layer" includes different types and/or combinations of layers.

Within the scope of this application, it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. For the avoidance of doubt, the terms "may", "and/or", "e.g.", "for example" and any similar term as used herein should be interpreted as non-limiting such that any feature so-described need not be present. Indeed, any combination of optional features is expressly envisaged without departing from the scope of the invention, whether or not these are expressly claimed. The applicant reserves the right to change any originally filed claim or file any new claim accordingly, including the right to amend any originally filed claim to depend from and/or incorporate any feature of any other claim, although not originally claimed in that manner.

The invention claimed is:

1. A conditioning head comprising:

a substrate comprising a substrate surface;

at least one vane comprising a non-planar abrasive region raised relative to the substrate surface, wherein the at least one vane has a two-region stepped profile that consists of:

an edge shaving region having a roughness $R_a$ of less than 10 microns; and a point cutting region positioned only between a peripheral edge of the conditioning head and a radial distance of at least 90% from a central axis of the conditioning head, the point cutting region comprising:

one or more protrusions, each protrusion having a height of at least 150% above a mean height of the edge shaving region;

wherein a ratio of a surface area of the edge shaving region to the point cutting region is at least 2:1.

2. The conditioning head of claim 1, wherein the edge shaving region is coated with a CVD diamond layer.

3. The conditioning head of claim 1, wherein the point cutting region comprises one or more protrusions comprising CVD diamond coated diamond grit.

4. The conditioning head of claim 1, wherein the point cutting region and the edge shaving region each comprise a polycrystalline diamond layer, an average grain size of the polycrystalline diamond layer on the point cutting region being greater than the average grain size of the polycrystalline diamond layer on the edge shaving region.

5. The conditioning head of claim 4, wherein the point cutting region is adjacent catalytic seeds disposed upon the substrate.

6. The conditioning head of claim 5, wherein the catalytic seeds comprise at least one of diamond, silicon, iron, cobalt, nickel and alumina.

7. The conditioning head of claim 1, wherein the one or more protrusions extend between 5 and 250 micron from the mean height of the edge shaving region.

8. The conditioning head of claim 1, wherein the one or more protrusions extend between 10 and 50 micron from the mean height of the edge shaving region.

9. The conditioning head of claim 1, wherein the one or more protrusions are rounded or convex.

10. The conditioning head of claim 1, wherein the one or more protrusions are nongeometric.

11. The conditioning head of claim 1, wherein the point cutting region comprising one or more isolated or clusters of protrusions.

12. The conditioning head of claim 1, wherein the ratio of the surface area of the edge shaving region to the point cutting region is at least 100:1.

13. The conditioning head of claim 1, wherein the ratio of the surface area of the edge shaving region to the point cutting region is at least 200:1.

14. The conditioning head of claim 1, wherein;

the raised non-planar abrasive region or $R_{es}$ comprises at least four radially extending vanes and between one and fifty protrusions, and each vane comprises between zero and five protrusions and said protrusion(s) are positioned greater than 70% along a radial line starting at the central axis and ending at the peripheral edge of the conditioning head.

15. The conditioning head of claim 1, wherein a ratio of heights of highest peaks above a mean line for the point cutting region ($R_{p2}$) and the edge shaving region ($R_{p1}$) is at least 2:1.

16. A chemical mechanical processing (CMP) conditioning head comprising:

a substrate comprising a substrate surface;

at least one vane comprising a non-planar abrasive region raised relative to the substrate surface, wherein at least one of the at least one vane has a two-region stepped profile that consists of:

an edge shaving region; and a point cutting region positioned only between a peripheral edge of the conditioning head and a radial distance of at least 90% from a central axis of the conditioning head;

wherein a ratio of a surface area of the edge shaving region to the point cutting region is at least 2:1; and wherein the point cutting region comprises one or more protrusions, each protrusion having a height of at least 150% above a mean height of the edge shaving region.

17. The chemical mechanical processing conditioning head of claim 16, wherein:

the at least one vane comprises one or more discrete raised non-planar abrasive segments, and the one or more segments comprises at least one of concentric circles, broken concentric circles, spirals, broken spirals segments, linear segments, broken linear segments, curved segments, or broken curved segments.

18. The chemical mechanical processing conditioning head of claim 17, wherein the point cutting region is distributed across one or more of the segments.

19. The chemical mechanical processing conditioning head of claim 17, wherein the point cutting region is distributed across less than 60% of the segments.

* * * * *